US006370705B1

(12) United States Patent
Levinson

(10) Patent No.: US 6,370,705 B1
(45) Date of Patent: Apr. 16, 2002

(54) FEMALE URINAL

(76) Inventor: Orde Levinson, Caudwell's Castle, Folly Bridge, Oxford (GB), OX1 4LB ( * ) Notice: Subject to any disclaimer, the term of this patent is extended or adjusted under 35 U.S.C. 154(b) by 0 days.

(21) Appl. No.: 09/646,498

(22) PCT Filed: Mar. 17, 1999

(86) PCT No.: PCT/GB99/00813

§ 371 Date: Oct. 31, 2000

§ 102(e) Date: Oct. 31, 2000

(87) PCT Pub. No.: WO99/47760

PCT Pub. Date: Sep. 23, 1999

(30) Foreign Application Priority Data

Mar. 17, 1998 (GB) ..... 9805728
Apr. 28, 1998 (GB) ..... 9809141

(51) Int. Cl.[7] ..... E03D 13/00

(52) U.S. Cl. ..... 4/301; 4/311; 4/251.1; 4/251.2; 4/300.3; 4/420

(58) Field of Search ..... 4/301, 311, 251.1, 4/251.2, 427, 420, 546, 559, 591, 300.3, DIG. 15, 496, 510, 341; 141/311 A, 339

(56) References Cited

U.S. PATENT DOCUMENTS 602,080 A * 4/1898 Hutchinson
916,864 A * 3/1909 Henhapl
1,155,885 A * 10/1915 Catchings
1,162,500 A * 11/1915 Madden
1,177,221 A * 3/1916 Young
1,354,199 A * 9/1920 Ketteringham
2,000,658 A * 5/1935 Bushold
2,182,979 A * 12/1939 Bruzenak
2,185,887 A * 1/1940 Dennis
2,431,330 A * 11/1947 Johnson
2,703,409 A * 3/1955 Manning et al.
3,964,110 A * 6/1976 Kapit
4,165,545 A * 8/1979 Stoltzfus
4,180,875 A * 1/1980 Wilson
4,620,332 A * 11/1986 Laird
5,497,814 A * 3/1996 Cannon
5,864,892 A * 2/1999 Cool
5,926,862 A * 7/1999 Liu
6,085,361 A * 7/2000 Whitaker
6,085,365 A * 7/2000 Chiang

* cited by examiner

*Primary Examiner*—Michael Powell Buiz
*Assistant Examiner*—Khoa Huynh
(74) *Attorney, Agent, or Firm*—Licata &Tyrrell P.C

(57) ABSTRACT

The present invention relates to a female urinal (20) comprising a body having a connection portion (22) for attachment to a support (21), a receiving portion (23) at the remote end from the support into which a female urinates, and a straddling portion (24) interposed therebetween. The straddling portion (24) is configured to afford space for the location of a user's thighs such that she can comfortably position herself above the urinal for accurate urination.

9 Claims, 2 Drawing Sheets

FEMALE URINAL

The present invention relates to a urinal for use by females.

Female public toilets are infamous for their long queues often caused by females applying make up in the cubicles, chatting or sharing cubicles. Females also often have less urinating facilities than men because their toilets require more space than traditional male urinals. This can cause problems especially at concerts, the theatre, museums or any public site including outdoor events and concerts when there is only a limited time to go to the toilet without having to miss part of the show.

Another problem with female public toilets are that they are often thought of as unhygienic because the females have to sit on a prior used and potentially contaminated seat. As a result many females using these toilets often adopt a horizontal squatting position, where the female's thighs are generally horizontal to the ground. In so doing they try to avoid contact with the seat. This can lead to problems of spraying on to the seat thus contaminating the seat for subsequent users. Disposable seat covers are sometimes available but they are not popular, partly because they are made from paper and so are not an adequate defence to stop bacterial contamination of a female's bottom nor do they stop any moisture travelling through the paper onto the female's bottom.

In many countries there are water shortages. Sit down conventional toilets use between 7 and 9 litres of water per flush. In public toilets men are provided with urinals which are less wasteful of water.

In some countries, public toilets are provided in the form of open holes in the ground enclosed by cubicles. The user straddles the hole, usually by placing their feet on blocks raised off the floor. The user then adopts a heel squatting position, where the body is self-supported by the user's thighs resting on the calves, before urinating or defecating into the hole. In the heel squatting position the user is in a relatively comfortable and stable position to urinate or defecate.

In U.S. Pat. No. 4,985,940 there is disclosed a sanitary fixture comprising an elongate flexible hose which has a urine collecting funnel at its top end and its bottom end is in communication with a water-holding bowl that is flushed by a siphoning action. A sanitary cuff lines the rim of the funnel so that the funnel does not contact the body of the user. The female user places the funnel under her urethra and urinates into it. Accordingly, the females' legs are in a straight leg position, that is where her legs are substantially straight without significant flexing at the knees, and slightly placed apart. This position is to be likened with that typically adopted by males while urinating.

After urination the funnel is placed into a hanger member which ejects the sanitary cuff after use. The problem with this device is that the female may contaminate her hand or the outside of the funnel while urinating and subsequent users must touch the funnel without it being cleaned.

An object of this invention is to provide a hygienic device for females who only wish to urinate, thus allowing a greater turnover of females than in traditional toilets and which reduces the amount of water per user.

According to a first aspect of the present invention there is provided a female urinal comprising a body having a connection portion for attachment to a support, a receiving portion at the remote end from the support into which a female urinates, and a narrower portion interposed therebetween which is relatively narrower than the receiving portion.

Users of the arrangement defined above adopt a bow-legged position instead of sitting down. As such, they cannot tarry and therefore there is a greater turnover of users. Also, it is possible to have a greater number of female urinals in the same space as a conventional toilet because such urinals are narrower and only require half-stall enclosures. As the urinal is only used for urinating into, the amount of water used in each flush can be reduced significantly.

The support can be moveable, for example on wheels, so that it can be used at temporary venues such as outdoor concerts.

In preferred embodiments, the receiving portion is generally cup shaded. The cup shape can encompass a large number of plan shapes, for example circles, ovals, rectangles, squares and elongated shapes.

Conveniently, the narrower portion comprises a leg locating portion for enabling the female to be astride that portion whilst urinating. In use, the female user pulls her panties aside or down to her ankles and then shuffles towards the urinal. She positions herself at the leg locating portion which is shaped in order that her legs are not spread too widely apart. The female user then bends her knees slightly into a bow-legged position so that her urethra is positioned over the receiving portion. Preferably the leg locating portion has a breadth of between 5 and 25 cm.

Preferably, the rim of the receiving portion overhangs the inside of the receiving portion. As such when urinating, any urine which may have a tendency to splash back when it hits the base or the side of the receiving portion, will not do so, thus avoiding splashes on to the urinating female, on to the outside of the receiving portion or on to the floor. In a preferred embodiment the breadth of the receiving portion is between 8 and 30 cm.

Conveniently, the overhang comprises one or more outlets. In preferred embodiments there are a plurality of outlets around the rim. These outlets can, for example, spray out jets of water which wash away the urine thus cleaning the urinal after use.

Preferably, a spillage collection groove is provided around at least part of the outer periphery of the receiving portion.

Conveniently, the spillage collection groove is sloped towards the narrower portion to connect to an inlet into the interior of the receiving portion.

The groove on the outer surface of the receiving portion is used to collect any splashes which run down the outside of the receiving portion. As the groove is sloped downwards the urine naturally runs to the lowest part where an inlet allows the urine to enter the receiving portion. Outlets can be placed at highest point of the groove which results in the groove being cleaned simultaneously with the rest of the receiving portion.

In one embodiment, the connection means includes an adjustable support wherein, in use, the height of the urinal can be altered. Females can vary considerably in their height, especially for example girls and female adults. With an adjustable support the female urinal can be placed at a different height suitable for the height of the user.

Preferably the height of the base of the receiving portion from the base of the support is 15–40 cm and the height of the rim of the receiving portion from the base of the support is 30–50 cm. Preferably the length of the female urinal is up to 120 cm.

Preferably the traddling portion is arranged in use to afford space for the location of the user's thighs.

In a second aspect of the invention there is provided a female urinal comprising a body having a connection portion for attachment to a support, a receiving portion at the remote end from the support into which a female urinates, and a straddling portion interposed therebetween; wherein the distance of the receiving portion from the straddling portion is greater than or substantially equal to the width at the straddling portion.

As female users adopt a bow-legged position instead of sitting down when using the urinal defined above, they cannot tarry and therefore there is a greater turnover of users. It is possible to have a greater number of female urinals in the same space as a toilet because they are narrower and only require half-stall enclosures. As the urinal is only used for urinating into the amount of water used in each flush can be reduced significantly.

The support can be moveable, for example on wheels, so that it can be used at temporary venues such as outdoor concerts.

Preferably the receiving portion and the straddling portion together form a trough. While a female is urinating the urine will freely run down the trough to an area where a drainage means is provided.

Conveniently the straddling portion comprises a leg locating portion which has a relatively narrower width than the remainder of the trough. The relatively narrow leg locating portion means that females who are wearing tight undergarments or trousers do not have problems straddling or adopting a bow-legged position over the urinal.

In this respect, in the context of the present invention the thigh is defined as any part of the leg from the groin to the knee.

According to a third aspect of the present invention there is provided a female urinal comprising a body having a connection portion for attachment to a support, a receiving portion at the remote end From the support and a straddling portion interposed therebetween; wherein, in use, the straddling portion is located at a sufficient distance from the receiving portion in order that the urethra of the user, when straddling the urinal, is positioned over the receiving portion.

Conveniently, in use, the user faces the support.

According to a fourth aspect of the present invention there is provided a female urinal comprising a body having a connection portion for attachment to a support, a receiving portion at the remote end from the support into which a female urinates, and a thigh straddling portion interposed therebetween; wherein the distance of the receiving portion from the thigh straddling portion is greater than or substantially equal to the width at the straddling portion.

Preferably the thigh straddling portion has a relatively narrower width than the remainder of the female urinal.

According to a fifth aspect of the present invention there is provided a female urinal comprising a body having a connection portion for attachment to a support, a receiving portion at the remote end from the support into which a female urinates and a straddling portion interposed therebetween; wherein the distance of the inside surface of the most remote point of the receiving portion from the support is greater than or substantially equal to the width at the straddling portion.

Conveniently the straddling portion is a thigh straddling portion, i.e a portion where the thighs of a user can straddle the urinal.

In a preferred embodiment the straddling portion is a leg locating portion, i.e where the legs of a user can straddle the urinal.

Preferably the straddling portion has a relatively narrower width than the remainder of the female urinal.

According to a sixth aspect of the present invention there is provided a female urinal comprising a body having a connection portion for attachment to a support, a receiving portion at the remote end from the support and a straddling portion interposed therebetween; wherein the urinal is configured to encourage a user to adopt a bow-legged straddling stance facing the support, with the user's urethra positioned above the receiving portion.

This invention will now be described, by illustration only, with reference to the following examples and the accompanying figures.

Figure 1:
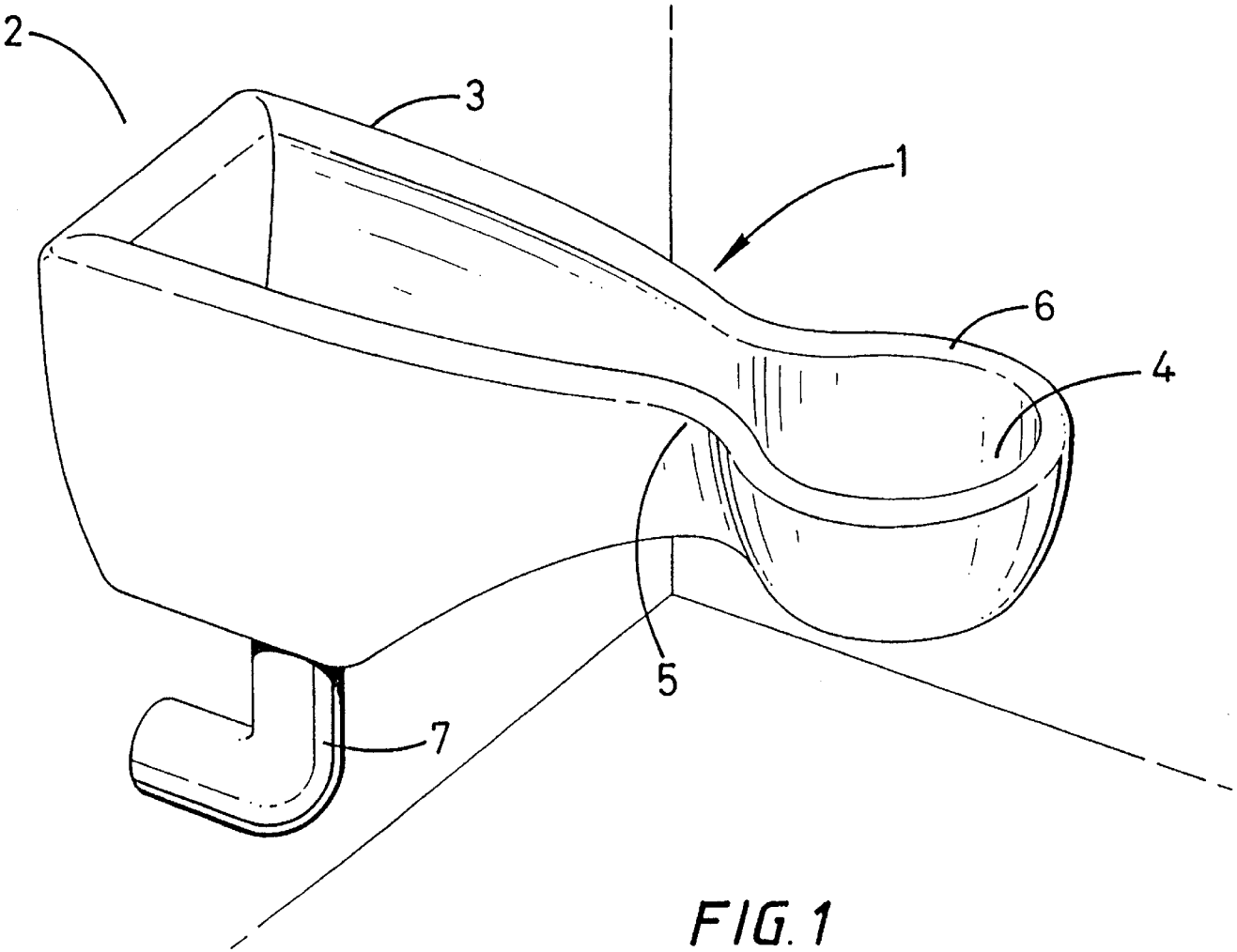
FIG. 1 is an oblique perspective view of a female urinal of the present invention.

FIG. 1 shows a female urinal 1, attached to a wall 2 via a connection portion 3. At the remote end of the female urinal from the support is a receiving portion 4. Interposed between the receiving portion 4 and the connection portion 3 is a narrower portion 5. The narrower portion 5 is a leg locating portion for enabling the female to be astride that portion whilst urinating.

The receiving portion 4 is generally bowl shaped, a rim 6 of which is bevelled in order that any urine which sprays onto the rim 6 will naturally run into the interior of the receiving portion 4. The rim 6 has a plurality of outlets for water (not shown).

The base of the connection portion 3 has a drainage means 7 leading through the support 2 to sewage pipes (not shown).

The female user (not shown) approaches the female urinal 1, and if wearing a skirt she lifts up her skirt and pulls her panties to her ankles or if she is wearing trousers pulls both her trousers and her panties to the floor. Then she shuffles forward until her legs are positioned astride the leg locating portions 5 in a bow-legged position. This position is more comfortable for the female user than a horizontal squatting position because her thighs are relatively further apart thereby making it easier to urinate accurately without spraying and/or urine running down her leg.

When her legs are in position, without moving them, she moves so that her urethra is above the receiving portion and then she urinates. If she splashes on to the rim or the receiving portion the urine will naturally run back into the receiving portion 4 due to the shape of the rim 6. After the female is finished urinating she shuffles backwards puts her clothes and panties back in the correct position and activates a flushing mechanism (not shown). This results in water or another fluid flowing out of the outlets in the rim 6. The fluid and the urine will travel to the drainage means 7 where they will be drain out of the urinal and into the sewage system.

Figure 2:
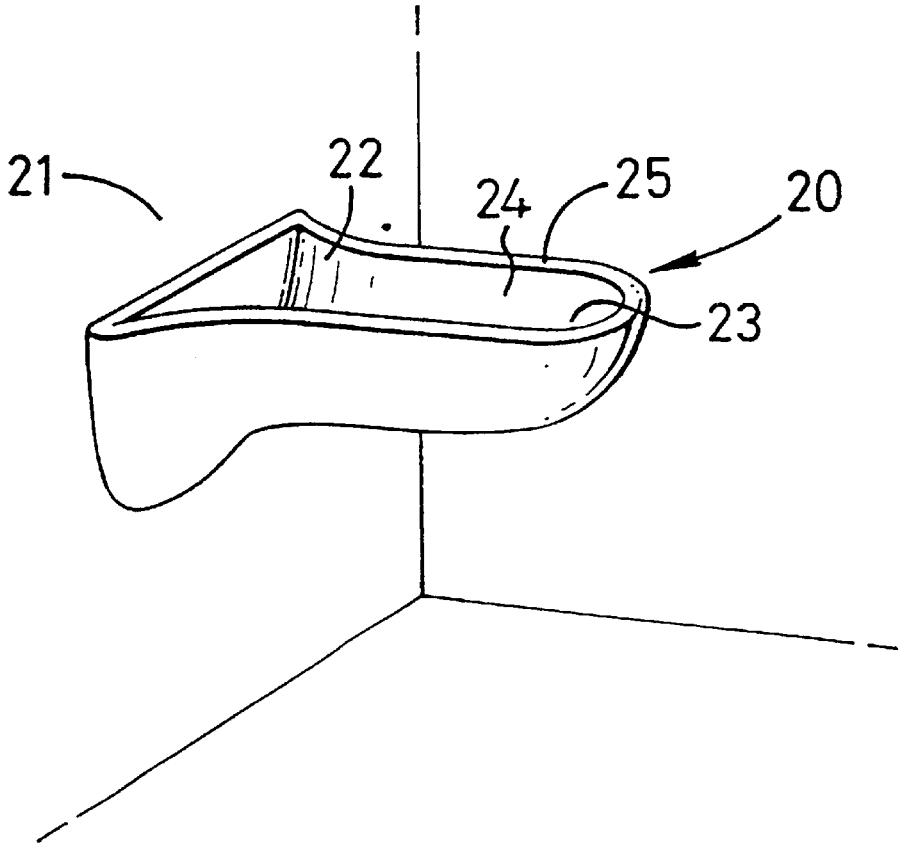
FIG. 2 is an isometric perspective of a female urinal of the present invention.

FIG. 2 shows a further female urinal 20 of the present invention, attached to a wall or support 21 via a connection portion 22. At the remote end of the female urinal 20 from the support 21 is a receiving portion 23. Interposed between the receiving portion 23 and the connection portion 22 is a straddling portion 24. The straddling portion 24 is the same width as the receiving portion 23 but the distance of the straddling portion 24 from the receiving portion 23 is greater than the width of the straddling portion 24.

The receiving portion 23 and the straddling portion 24 form a trough which has a bevelled rim 25. The rim 25 is bevelled in order that any urine which sprays onto the rim 25 will naturally run into the interior of the receiving portion 23. The rim 25 has a plurality of outlets for water (not shown).

The base of the connection portion 22 has a drainage means (not shown) leading through the support 21 to sewage pipes (not shown).

In use, the female user (not shown) approaches the female urinal 20, and if wearing a skirt she lifts up her skirt and pulls her panties to her ankles or if she is wearing trousers pulls both her trousers and her panties to the floor. Then she shuffles forward until her legs are positioned, in a bow-legged position, astride the straddling portions 24. When her legs are in position, without moving them, she moves so that her urethra is above the receiving portion 23 and then she urinates. If she splashes on to the rim 25 of the receiving portion 23 the urine will naturally run back into the receiving portion 23 due to the shape of the rim 25. After the female is finished urinating she shuffles backwards puts her clothes and panties back in the correct position and activates a flushing mechanism (not shown). This results in water or another fluid flowing out of the outlets in the rim 25. The fluid and the urine will travel to the drainage means where they will drain out of the urinal and into the sewage system.

Figure 3:
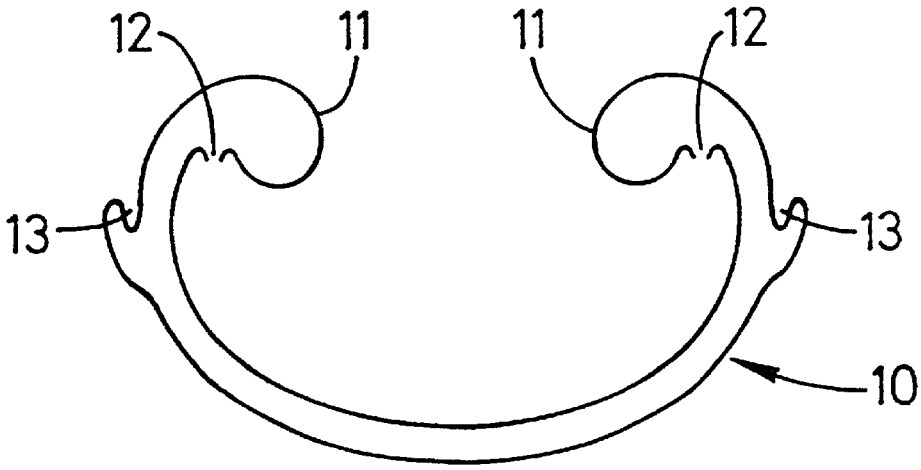
FIG. 3 is a cross-section through the receiving portion of a urinal of the present invention.

FIG. 3 shows a cross section of a receiving portion 10 for use in a urinal of the present invention. A rim 11 overhangs the inside of the receiving portion 10 and has an outlet 12 in the overhang. On the outer surface of the receiving portion 10 an open-topped spillage collection groove 13 is formed which, in use, extends upwardly.

While the female is urinating the urine may splash up the sides of the receiving portion but the overhanging rim 11 ensures that no urine splashes back on the urinating female or splashes over the side onto the outside of the receiving portion 10 or onto the floor. If the female misdirects her urine and it runs down the outside of the receiving portion 10 it will not travel any further than the groove 13. The groove 13 is sloped towards the base of the receiving portion 10 and at its lowest part there is a channel (not shown) which allows an urine in the groove to re-enter the receiving portion 10. At the highest point of the groove in use a flushing water/fluid outlet (not shown) is provided so that when the flushing mechanism of the urinal is activated water or another fluid will flow out of the outlets 12 and the outlet in the groove so that both the receiving portion 10 and the groove 13 are cleaned before the next user starts to use the urinal.

It will be understood that the embodiments illustrated show certain applications of the invention only for the purposes of illustration. In practice the invention may be applied to many different configurations, the detailed embodiments being straightforward for those skilled in the art to implement.

For example, the female urinal could be produced from ceramic, steel, wood, stone or any other suitable material. The female urinal can also be attached to an adjustable support which alters the height of the urinal according to the female user's wishes. The height of the urinal could be altered manually or electronically or by any other mechanism known to those skilled in the art.

In variants of the urinal, the connecting portion or part thereof could be concealed behind the wall or could be covered by a removable cover. Also, the connecting portion may be attached to a moveable support for use at temporary venues.

It will be appreciated that other shapes of connection portion and receiving portion can be used. However, by having a straddling or narrower portion, a female user can be astride the urinal to ensure accurate urination into the receiving portion.

What is claimed is:

1. A female urinal comprising a generally elongate body having:

a connection portion at one end attaching the urinal to an upright support to be located at substantially urethra height of a standing female user;

a urine receiving portion at an opposite other end having an outer periphery, an inner periphery and a rim; and a thigh straddling portion disposed between the connection portion and urine receiving portion;

wherein the thigh straddling portion and urine receiving portion have a width allowing the standing female user to move onto and astride the urinal attached to the upright support and allowing the standing female user adopting a urinating position which is bow-legged and facing the upright support;

wherein the urine receiving portion is spaced from the upright support to receive urine directed in the direction of the upright support by the standing female user urinating whilst in said urinating position; and wherein a spillage collection groove is formed onto the outer periphery of the urine receiving portion adjacent rim.

2. The female urinal according to claim 1 wherein the urine receiving portion is generally cup shaped.

3. The female urinal according to claim 1 wherein the thigh straddling portion is a narrower portion than the urine receiving portion.

4. The female urinal according to claim 3 wherein the narrower portion is arranged in use to afford space for the location of a user's thigh.

5. The female urinal according to claim 1 wherein the rim of the urine receiving portion having an overhang portion disposed on the inner periphery portion of the urine receiving portion.

6. The female urinal according to claim 5 wherein the overhang portion comprises one or more outlets.

7. The female urinal according to claim 6 wherein the overhang portion comprises a plurality of outlets.

8. The female urinal according to claim 1 wherein a distance of the thigh straddling portion from the urine receiving portion is greater than or substantially equal to the width of the thigh straddling portion.

9. The female urinal according to claim 8 wherein the urine receiving portion and thigh straddling portion together form a trough.

* * * * *

UNITED STATES PATENT AND TRADEMARK OFFICE

CERTIFICATE OF CORRECTION

PATENT NO. : 6,370,705 B1
DATED : April 16, 2002
INVENTOR(S) : Orde Levinson

It is certified that error appears in the above-identified patent and that said Letters Patent is hereby corrected as shown below:

Column 2,
Line 13, please delete "shaded" and insert -- shaped --.

Column 5,
Line 36, please delete "an" and insert -- any --.

Signed and Sealed this

Eighteenth Day of November, 2003

JAMES E. ROGAN
*Director of the United States Patent and Trademark Office*